US008328018B2

(12) United States Patent
Sack et al.

(10) Patent No.: US 8,328,018 B2
(45) Date of Patent: Dec. 11, 2012

(54) CHILD-RESISTANT CARDED BLISTER PACKAGE AND METHOD OF MANUFACTURE

(75) Inventors: Ryen Sack, Hampshire, IL (US); Curtis A. Knutson, Loves Park, IL (US)

(73) Assignee: AndersonBrecon Inc., Rockford, IL (US)

( * ) Notice: Subject to any disclaimer, the term of this patent is extended or adjusted under 35 U.S.C. 154(b) by 43 days.

(21) Appl. No.: 12/939,330

(22) Filed: Nov. 4, 2010

(65) Prior Publication Data

US 2012/0111761 A1 May 10, 2012

(51) Int. Cl.
*B65D 83/04* (2006.01)

(52) U.S. Cl. ..... 206/531; 206/484; 206/484.2

(58) Field of Classification Search ..... 206/531, 206/532, 462, 469, 539, 484, 484.2
See application file for complete search history.

(56) References Cited

U.S. PATENT DOCUMENTS 4,958,736 A 9/1990 Urheim
7,144,635 B2 12/2006 Hawes et al.
7,401,702 B2 * 7/2008 Hession ..... 206/531
7,896,161 B2 * 3/2011 Reilley et al. ..... 206/531
2007/0080090 A1 4/2007 Gherdan et al.
2007/0221534 A1 * 9/2007 Intini ..... 206/531
2007/0235366 A1 10/2007 Desai et al.
2007/0246396 A1 10/2007 Brollier
2008/0110791 A1 * 5/2008 Specker ..... 206/531
2009/0107873 A1 * 4/2009 Cotton et al. ..... 206/531
2009/0178949 A1 7/2009 Reilley et al.

* cited by examiner

*Primary Examiner* — Andrew Perreault
(74) *Attorney, Agent, or Firm* — Howson & Howson LLP

(57) ABSTRACT

A carded package includes a front card bonded to a rear card with a blister card captured therebetween. The blister card has upstanding blister compartments projecting through openings of the front card. The rear card extends over an opposite face of the blister card and is a laminate including a tear-resistant polymeric layer bonded to a paperboard layer. The polymeric layer extends adjacent the blister card and the paperboard layer of the laminate extends remote from the blister card forming an exposed surface of the rear card. The rear card includes perforations aligned behind the blister compartments. The perforations include a first set of perforations cut entirely through the paperboard and polymeric layers and a second set of perforations cut into the paperboard layer and not into or entirely through the polymeric layer. A method of assembling a carded package is also disclosed.

6 Claims, 3 Drawing Sheets

CHILD-RESISTANT CARDED BLISTER PACKAGE AND METHOD OF MANUFACTURE

BACKGROUND OF THE INVENTION

The present invention relates to a package for containing items, such as doses of medicine, that can be dispensed therefrom, and more particularly, the present invention relates to a package including a blister card that has child-resistant dispensing properties and to a method of making a carded blister.

An example of a carded blister package is disclosed by U.S. Patent Application Publication No. 2009/0178949 A1 of Reilley et al. which is assigned to Anderson Packaging, Inc., the assignee of the present application. The package includes a blister card having blister compartments in which tablets are located and retained therein via a thin foil backing layer. The blister card is retained within several layers of paperboard heat sealed together to form the carded package and to provide a requisite amount of child resistance.

By way of example, one embodiment of a carded package disclosed in the above referenced application publication includes a top paperboard layer through which the blister compartments extend and three oppositely located heat sealed paperboard layers underlying the foil layer of the blister card. Thus, this particular package has a total of four paperboard layers. Dispensing a tablet from the carded package requires the exertion of a force applied in a downward direction on the blister compartment to force the tablet through the rear face of the carded package. The force must be sufficient to break through the foil layer as well as at least one of the paperboard layers. The paperboard layer may be perforated to define break-away panels, punch outs, or so-called "chads" that require a predetermined amount of force to be applied to the blister compartment for the tablet to successfully break through the paperboard layer and rear face of the package.

The above referenced carded package is particularly useful in consumer packaging applications, for instance, packaging of pharmaceuticals or unit dose pharmaceuticals. Unit dose packaging is useful for certain pharmaceutical applications that require the package to be opened and closed repeatedly until the course of medication is complete. Such a package enables the user to easily track the consumption of doses according to a prescribed schedule. Child resistance is a feature particularly desired for unit dose pharmaceutical packaging in which a preferred package should have a so-called child resistance (CR) rating of F=1 to ensure that the package has sufficient integrity to prevent unwanted access of the medicine by a young child in the event that the young child gains possession of the package.

Although the above referenced carded package disclosed by the above referenced published application may be satisfactory for its intended purpose, there is a need for a carded package of different and novel construction. The carded package should be tear resistant and be unable to be easily torn or bitten or chewed through by a young child to prevent the young child from gaining access to medication stored in the blister compartments. Thus, the carded package should provide a desired amount of child-resistance, such as achieve a F=1 child resistant rating, yet enable tablets to be readily dispensed by an intended end-user, such as a senior citizen. Further, the desired package should be inexpensive to manufacture and capable of being assembled in an efficient process.

BRIEF SUMMARY OF THE INVENTION

According to the present invention, a child-resistant carded package for storing and dispensing tablets and like small individual items is provided. The child-resistant carded package includes a front card bonded to a separate rear card with a blister card captured and held in a protected condition therebetween. The blister card has a face from which a plurality of separate upstanding blister compartments project and over which the front card extends. The front card can be a layer of paperboard having openings registering with the blister compartments such that the blister compartments project through the openings of the front card. The rear card extends over an opposite face of the blister card and is a laminate including a tear-resistant polymeric layer bonded to a paperboard layer. The polymeric layer of the laminate extends adjacent the blister card and the paperboard layer of the laminate extends remote from the blister card relative to the polymeric layer and provides an exposed surface of the rear card. The rear card includes perforations that are aligned behind the blister compartments of the blister card and that define paths through which tablets being dispensed from the blister compartments must pass. The perforations include a first set of perforations that are cut entirely through both the paperboard and polymeric layers of the laminate and a second set of perforations that are cut into the paperboard layer and not into or entirely through the polymeric layer.

According to another aspect of the present invention, a method of manufacturing a child-resistant carded package for containing tablets or like items is provided. A front card is bonded to a separate rear card with a blister card captured therebetween to form a carded package assembly. The blister card has a plurality of separate upstanding blister compartments extending through openings in the front card. Before the bonding step, perforations are cut into the rear card such that they become aligned behind the blister compartments during the bonding step. The rear card is a laminate including a paperboard layer bonded to a polymeric layer, and the cutting step includes cutting a first set of perforations that are cut entirely through both the paperboard and polymeric layers of the laminate and cutting a second set of perforations that are cut into the paperboard layer and not into or entirely through the polymeric layer.

BRIEF DESCRIPTION OF THE DRAWINGS

The present invention should become apparent from the following description when taken in conjunction with the accompanying drawings, in which.

DETAILED DESCRIPTION OF THE INVENTION

Figure 1:
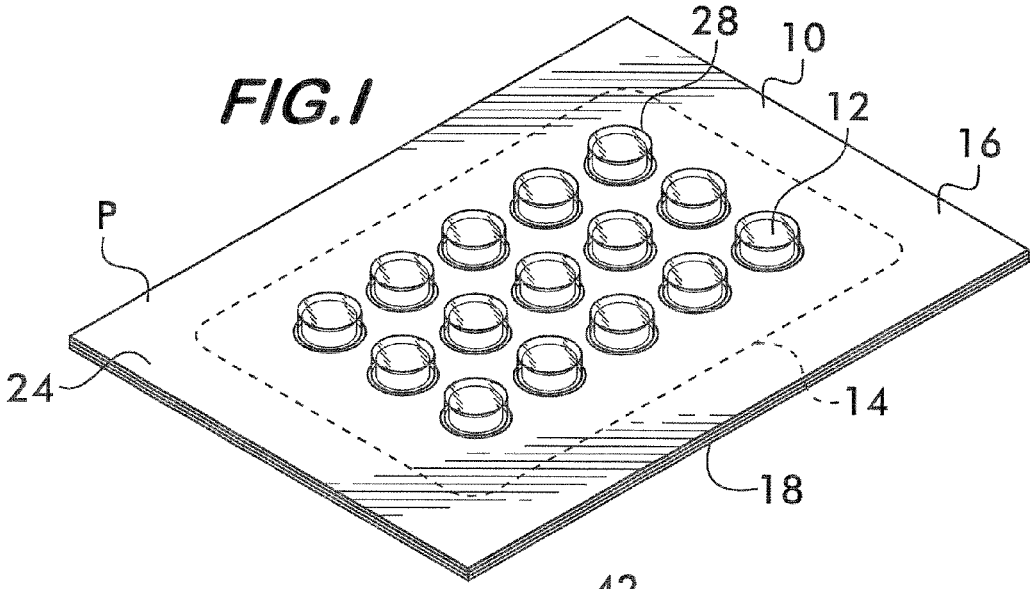
FIG. 1 is a perspective view of an upper or top face of a carded package from which blister compartments project according to the present invention.
Figure 2:
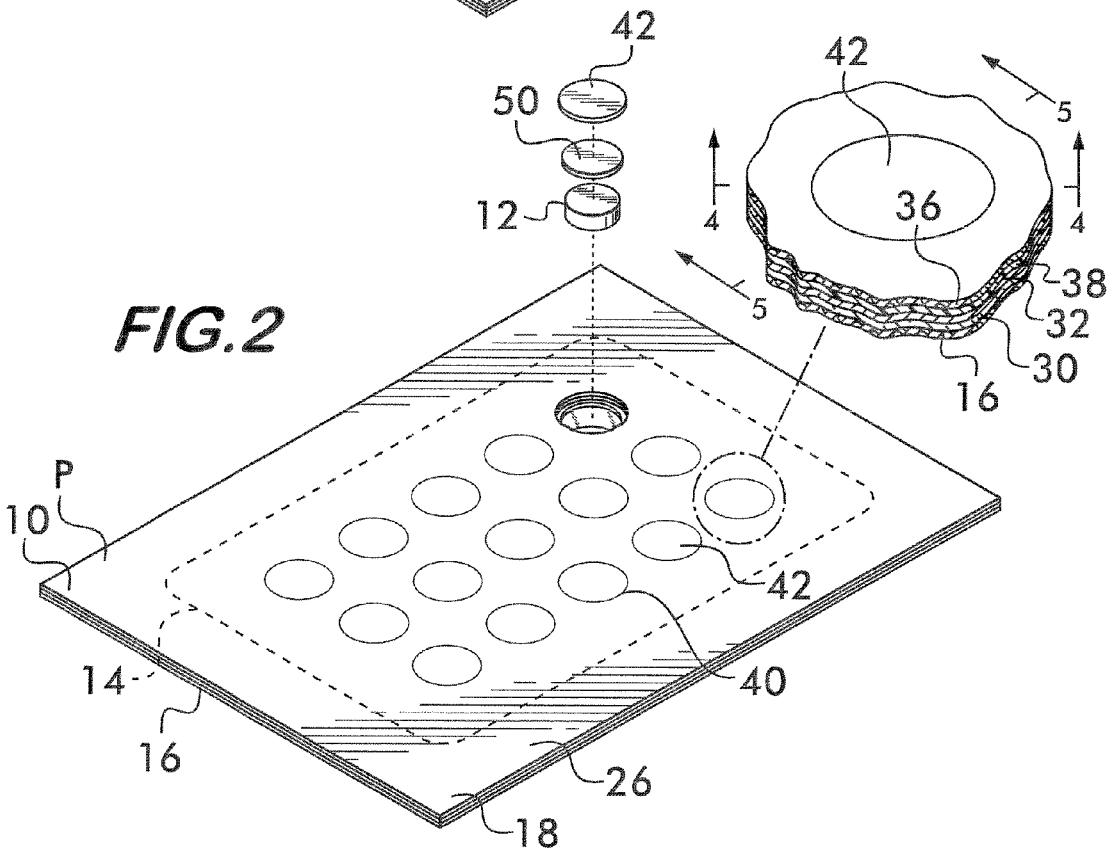
FIG. 2 is a perspective view of an underside or rear face of the carded package of FIG. 1 through which tablets must break through to be dispensed from the package, and FIG. 2 includes exploded and magnified break-away illustrations of parts of the package.

An assembled carded package or package component 10 according to an embodiment of the present invention is illustrated in FIGS. 1 and 2. The illustrated package or package component 10 individually contains, stores, and protects a series of tablets 12. By way of example, the tablets 12 can be doses of medicine, vitamins, supplements, gum, candy, or any other product that is provided in tablet or like form. As will be discussed in greater detail below, the carded package 10 possesses child-resistant, senior-friendly dispensing properties.

In this application, the product 10 illustrated in FIGS. 1 and 2 is described as a package or a package component. Thus, it should be understood that the illustrated product 10 may merely form a component of an overall package system. For instance, the package system could include external wrapping such as a simply box, protective sleeve, or the like in which the carded product 10 is inserted. Alternatively, the carded product 10 can be provided with a cover flap in the nature of a booklet style package. Thus, the term "package" or "product" as used herein also refers to a package component of an overall packaging system and is not limited to use of the component by itself.

Figure 3:
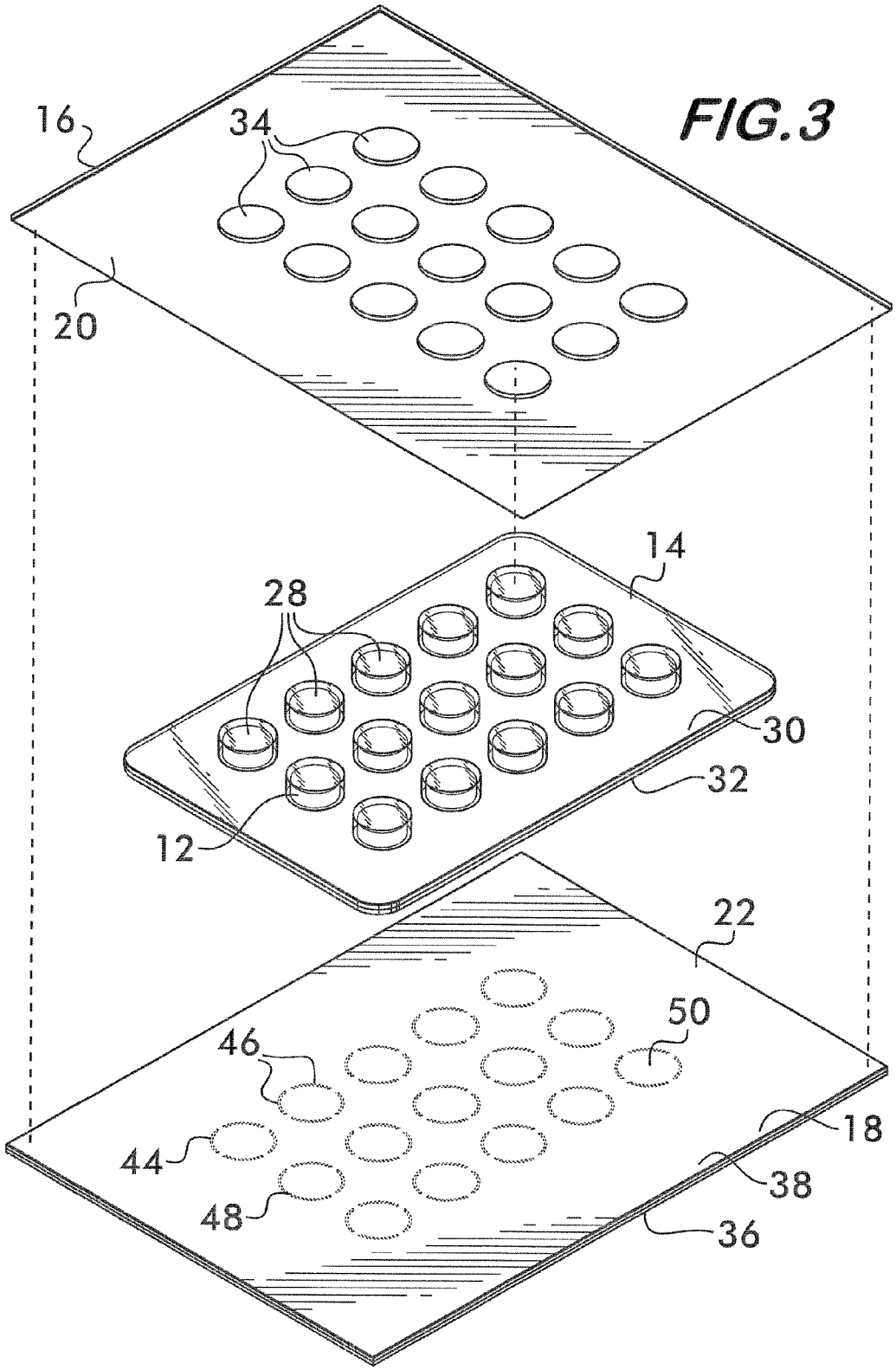
FIG. 3 is an exploded perspective view of the carded package showing a blister card sandwiched and embedded between a top layer of the package having blister compartment-receiving apertures and a rear layer of the package having perforations defining punch-out panels (i.e. "chads")

As best illustrated in FIG. 3, the carded package or package component 10 includes a blister card 14 sandwiched between a front card 16 and a rear card 18, to form a laminate structure. The inward-facing surfaces, 20 and 22, of the front and rear cards, 16 and 18, respectively, can be coated with a heat or pressure sensitive adhesive coating so that the front and rear cards, 16 and 18, can be tightly sealed together and to the opposed surfaces of the blister card 14 thereby sealing, capturing and embedding the blister card 14 therebetween. The exposed surfaces, 24 and 26, of the front and rear cards, 16 and 18, respectively, form an exterior side of the carded package 10 and can have a glossy, textured, decorative, or printable surface enabling indicia such as product information to be printed or provided thereon.

With respect to the blister card 14, it can be designed to carry any number of a plurality of separate items, such as tablets 12, in any array or layout pattern, shape, or size of blister compartments 28. In the illustrated embodiment, the hollow blister compartments 28 are of a uniform cylindrical shape provided in a uniform three-by-five array. This showing is for purposes of example only, and other shapes, sizes and layout patterns can be used. The items such as tablets 12 carried by the blister card 14 can be dispensed individually over time, or in sets.

The blister card 14 can be of any structure such as a typical structure that includes a substantially planar tray 30 formed with and defining blister compartments 28 upstanding from the tray 30. A rupturable backing layer 32 can be laminated to a rear face of the tray 30 to seal and close items such as tablets 12 in the blister compartments 28. By way of example, the tray 30 can be a plastic sheet that is thermoformed to produce upstanding blister compartments 28. In most instances, the material of the tray 30 is transparent or translucent to enable the content of the blister compartments 28 to be visually determined by a user. Of course, in some cases, it may be desirable for the material of the tray 30 to be tinted or opaque. The backing layer 32 is typically a thin sheet of paper or foil or other like material.

The structure of the blister card 14, including tray 30 and backing layer 32, by itself provides little resistance to a young child from accessing its contents should the young child gain possession of the blister card 14. Thus, the addition of the front card 16 and rear card 18 is required to provide the requisite amount of child resistance for the carded package 10. For example, the front and rear cards, 16 and 18, may be provided and sealed together such that the carded package 10 achieves a so-called F=1 child-resistance rating defined by industry standards.

The front card 16 can be a single sheet or layer of a paper or paperboard material. For example, the front card 16 may be a SBS (solid bleached sulfate) paperboard stock material. Of course, materials other than paperboard and materials within a range of thicknesses can be used. However, the material used for the front card 16 should be provided in a relatively flat blank form in which openings or apertures 34 can be readily cut, punched and/or formed before assembly of the carded package 10. Thus, as best shown in FIG. 3, the openings 34 are of a pattern, size and shape such that they are capable of being aligned with the pattern of blister compartments 28 on the blister card 14 when assembled with the blister card 14. Accordingly, during assembly, the front card 16 is applied and passed over the array of blister compartments 28 so that the front card 16 lies flush with and against the face of the tray 30 of the blister card 14. In addition, the front card 16 lies flush with and against the rear card 18 at peripheral portions "P" of the carded package 10 to which the blister card 14 does not extend. Each opening 34 can be circular or any other shape and size provided that the opening 34 closely matches the configuration of the blister compartment 28, more specifically the shape and size of the base of the blister compartment 28, to provide a high level of tamper resistance of the blister compartments 28. Thus, the only parts of the blister card 14 that are exposed on the carded package 10 are the walls forming the upstanding blister compartments 28. All other sections of the blister card 14 are hidden and protected by the front and rear cards, 16 and 18.

As discussed above, the material of the front card 14 can be capable of being coated with a continuous or discontinuous layer of a heat and/or pressure activated adhesive on its inward facing side 20 for purposes of securing the carded package 10 together. In addition, the surface 24 of the front card 16 can be glossy or otherwise of a desired texture and/or appearance for forming the visible external top surface 24 of the carded package 10.

The rear card 18 is located behind the blister card 14 in direct engagement with the backing layer 32 of the blister card 14. Thus, the rear card 18 is located on an opposite side of the blister card 14 relative to the front card 16 as best shown in FIG. 3. Since the tablets 12 are dispensed by applying a force in a downward direction (see arrow "F" in the FIGS. 4 and 5) on the blister compartments 28, the tablets 12 are required to pass through a rear of the carded package 10, and thus, the rear card 18 essentially defines the amount of force required to enable a tablet 12 to break free and be dispensed from the carded package 10.

The rear card 18 can be provided as a laminate of at least two layers tightly bonded or sealed together. For example, the rear card 18 can include a first layer 36 of paperboard such as a SBS (solid bleached sulfate) paperboard stock material similar to that used for the front card 16 and a second layer 38 of a relatively-thin, tear-resistant polymeric sheet material. See FIGS. 2, 4 and 5 for showings of the first and second layers, 36 and 38. Thus, the first and second layers, 36 and 38, of the rear card 18 are made of different materials and have different properties. One such property is the ability to be cut, such as by a laser, as will be discussed in greater detail. Also, the second layer made of polymeric material provides greater resistance to tearing, biting and chewing relative to that of the first layer made of paperboard despite being able to be thinner than the paperboard layer.

The polymeric second layer 38 forms the inward facing surface 22 of the rear card 18 as best illustrated in FIG. 3. Thus, the polymeric, tear-resistant second layer 38 of the rear card 18 directly engages the backing layer 32 of the blister card 14 and directly engages the front card 16 along peripheral portions "P" of the carded package 10 beyond the periphery of the blister card 14. Accordingly, the first layer 36 of paperboard material of the rear card 18 forms the exposed surface 26 of the rear card 18 best shown in FIG. 2. The first and second layers, 36 and 38, are sealed together with an adhesive or the like and together form the rear card 18.

After the rear card 18 is formed of the multiple layers and before being assembled with the other components of the carded package 10, the rear card 18 is subject to a cutting operation in which punch outs or chads are defined with a pattern of perforations. When the carded package 10 is assembled, the punch outs or chads register with and are aligned directly behind the blister compartments 28 thereby defining paths through which tablets 12 are dispensed from the carded package 10. The perforations and punch out or chads also determine the level of force required to break a tablet through the rear of the carded package 12.

In one contemplated embodiment of the present invention, a laser is used to precisely cut the pattern of perforations in the rear card 18. As stated above, the first and second layers, 36 and 38, (paperboard and polymeric materials) have different cutting properties. Thus, a laser can be directed toward the paperboard side (first layer 36) to accurately cut entirely through or partially through the paperboard but not into the polymeric material (second layer 38). The cutting energy of the laser can be adjusted to cut entirely through or partially through the paperboard layer 36 and the polymeric layer 38 as desired in making a pattern of perforations. This enables a unique pattern of perforations to be applied to the rear card 18 including some perforations that are cut entirely or partially through the first layer 36 only and some perforations that are cut entirely through the first layer 36 and entirely or partially through the second layer 38.

In one contemplated embodiment shown in the drawings, a continuous perforation 40 (circular as shown in the drawings) is cut entirely through the first layer 36 of paperboard. Here a circular shape is illustrated solely for purposes of example, and it should be understood that it is well within the scope of the invention to use any other shape of perforation (i.e. oval, square, rectangular, diamond, multi-sided, cruciform etc.).

The continuous perforation 40 defines the boundary or periphery of a like-shaped paperboard punch out or chad 42. Since the perforation 40 is continuous, the chad 42 is completely separated from the surrounding paperboard layer 36. However, the paperboard chad 42 remains secured to the carded package 10 since it is adhesively sealed or bonded to the second layer 38 of polymeric material.

Figure 4:
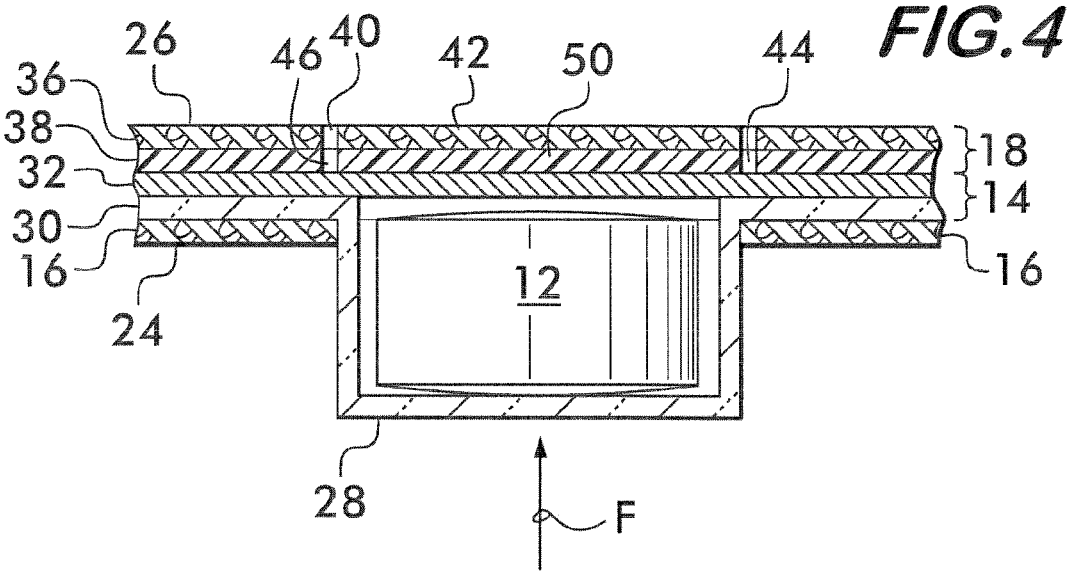
FIG. 4 is a cross-sectional view of the carded package taken along line 4-4 of FIG. 2.
Figure 5:
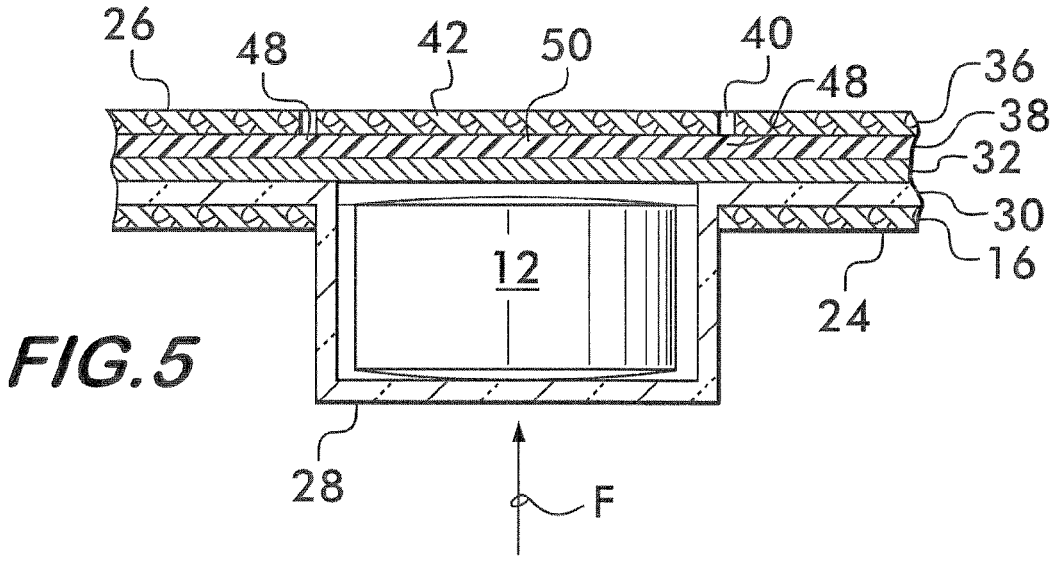
FIG. 5 is a cross-sectional view of the carded package taken along line 5-5 of FIG. 2.

With respect to the second layer 38 (polymeric material layer), a discontinuous perforation pattern 44 is formed and, as illustrated, includes four arcuate perforations 46 separated by lands 48 formed by uncut or only partially cut sections of the polymeric layer 38. This is best shown in FIGS. 3-5 and forms polymeric chads 50 that integrally interconnect to the surrounding polymeric layer 38 via the lands 48. Each polymeric chad 50 is aligned with one of the paperboard chads 42 directly behind one of the blister compartments 28. Thus, the force required to break a tablet 12 through the rear card 18 is determined by the force required to break the lands 48, or at least one or more of the lands 48, of the polymeric tear-resistant material. By way of example, the amount of force required to dispense a tablet 12 through the rear card 18 may be designed to be within a range of 8 to 14 lbs. of pressure which can be used to provide a requisite amount of child resistance.

As stated above, although circular perforations and chads are illustrated, this is merely for purposes of example and it should be clear that any pattern, shape or size of perforations (i.e. oval, square, cross-shaped, rectangular, etc.) and/or chads can be used within the scope of the present invention. Also, for purposes of example, FIG. 4 illustrates a cross section taken through the rear card 18 where perforations extend entirely through both the first and second (paperboard and polymeric) layers, 36 and 38, and FIG. 5 illustrates a cross section taken through the rear card 18 where perforations extend entirely through the first (paperboard) layer 36 but not into the second (polymeric) layer 38 thereby forming lands 48 at these uncut locations.

The above described carded package 10 provides several different means for providing child resistance. First, the polymeric layer 38 provides a significant amount of tear resistance despite its relatively thin size. Thus, a young child is unable to tear the carded package 10 and is unable to bite or chew through the carded package 10. In addition, the laminate is heat sealed together with the front and rear cards, 16 and 18, extending beyond the outer periphery of the blister card 14 thereby eliminating any access points on the edges of the carded package 10 that could be peeled or split apart. Further, since the paperboard chads 42 are completely cut from the remaining paperboard layer 36 of the rear card 18, a young child may be able to peel away a paperboard chad 42. Such removal of the paperboard chad 42 may provide a sense of accomplishment for a young child whose attention will now be turned away from the tablets 12 within the carded package 10 and toward the dislodged paperboard chad 42. This removal does not weaken the child resistance provided by the polymeric layer 38. Thus, the paperboard chads 42 form a sacrificial part of the carded package 10 which is not required to maintain child resistance but may provide a safe diversion to a young child.

Turning to a method of manufacturing a carded package 10 according to the present invention, the front card 16 can be separately formed or die cut from paperboard stock such that openings 34 closely matching the size of blister compartments 28 are formed in the paperboard stock. In addition, a laminate of paperboard and polymeric materials can be used to form the rear card 18. The rear card 18 is subject to a cutting operation or the like to form a desired pattern of perforations defining punch outs or chads.

According to one contemplated embodiment, the cutting operation is performed with a laser to precisely cut a pattern of perforations. The energy of the laser can be automatically adjusted during a cutting operation to simultaneously cut entirely through both the paperboard and polymeric layers of the rear card 18 or through the paperboard layer but not the polymeric layer at any position along a line of cut. Alternatively, the laser can be set to cut only partially through the paperboard layer or entirely through the paperboard layer and only partially through the polymeric layer. In this manner, a pattern of perforations, lands, chads or punch outs can be simultaneously and precisely formed in the rear card 18 which define a desired amount of force necessary to dispense a tablet 12 from the carded package 10. Also, where tablets of different sizes are provided in blister compartments on the same blister card 14, the perforations and lands can be adjusted to accommodate the different requirements of force needed for the different sizes of tablets.

After the above-referenced cutting operations are completed, the blister card 14 is secured between the front and rear cards, 16 and 18, to provide the package. The front and rear cards, 16 and 18, can be coated within an adhesive that is activated when the front and rear cards are pressed together and/or heated.

While packages and methods of manufacture and assembly have been described in detail, various modifications, alterations, and changes may be made without departing from the spirit and scope of the carded package and method according to the present invention as defined in the appended claims.

The invention claimed is:

1. A child-resistant carded package or package component, comprising:

a front card bonded to a separate rear card with a blister card captured therebetween;

said blister card having a face from which a plurality of separate upstanding hollow blister compartments project;

said front card extending over said face of said blister card and including a series of openings registering with said blister compartments such that said blister compartments extend through said openings of said front card;

said rear card extending over an opposite face of said blister card and being a laminate including a tear-resistant layer bonded to a further layer made of a different material than said tear-resistant layer, said tear-resistant layer of said laminate extending adjacent said blister card with said further layer extending remote from said blister card relative to said tear-resistant layer and providing an exposed surface of said rear card;

said rear card including perforations defining break-away chads aligned behind said blister compartments of said blister card;

each of said break-away chads including a first layer made of said tear-resistant layer and a second layer bonded to said first layer and made of said further layer;

said second layer of each of said chads being entirely disconnected and severed from a surrounding portion of said further layer of said laminate of said rear card by a continuous perforation and only remaining attached to said rear card by being bonded to said first layer of said chad; and said first layer of each of said chads interconnecting to a surrounded portion of said tear-resistant layer of said laminate of said rear card via lands extending between perforations;

whereby a force required to fracture at least one of said lands defines a minimum force required to dispense an item contained in one of said blister compartments through said rear card.

2. A child-resistant carded package according to claim 1, wherein said tear-resistant layer of said laminate is made of a polymeric material, and wherein said further layer of the said laminate is made of a paperboard material.

3. A child-resistant carded package according to claim 2, wherein said front card is made of a paperboard material.

4. A child-resistant carded package according to claim 3, wherein said paperboard materials of said front card and said further layer of said rear card are made of a SBS (solid bleached sulfate) paperboard material.

5. A child-resistant carded package according to claim 2, wherein said blister compartments of said blister card form the only parts of said blister card that are exposed on the carded package.

6. A carded component or package for containing a plurality of tablets, consisting of a front card bonded to a separate rear card with a blister card being captured therebetween;

said blister card having a face from which a plurality of separate upstanding blister compartments project and said front card extending over said face of said blister card and consisting of a single layer of paperboard having openings registering with said blister compartments such that said blister compartments extend through said openings of said front card, said blister compartments forming the only part of said blister card that is exposed outside of said front and rear cards;

said rear card extending over an opposite face of said blister card and consisting of a two layer laminate of a tear-resistant polymeric layer bonded to a paperboard layer, said polymeric layer confronting said blister card and said paperboard layer of said laminate providing an exposed surface of said rear card;

said rear card having perforations defining break-away chads aligned behind said blister compartments of said blister card;

each of said break-away chads including a tear-resistant polymeric chad layer and a paperboard chad layer bonded to said tear-resistant polymeric chad layer;

said paperboard chad layer of each of said chads being entirely disconnected and severed from a surrounding portion of said paperboard layer of said laminate of said rear card by a continuous perforation and only remaining attached to said rear card by being bonded to said tear-resistant polymeric chad layer of said chad; and said tear-resistant polymeric chad layer of each of said chads interconnecting to a surrounded portion of said tear-resistant polymeric layer of said laminate of said rear card via lands extending between perforations;

whereby a force required to fracture at least one of said lands defines a minimum force required to dispense an item contained in one of said blister compartments through said rear card.

* * * * *